US009415623B2

(12) United States Patent
Li

(10) Patent No.: US 9,415,623 B2
(45) Date of Patent: Aug. 16, 2016

(54) SIMPLE PAPER FASTENER

(71) Applicant: Liang Li, Shenzhen (CN)

(72) Inventor: Liang Li, Shenzhen (CN)

( * ) Notice: Subject to any disclaimer, the term of this patent is extended or adjusted under 35 U.S.C. 154(b) by 142 days.

(21) Appl. No.: 14/195,021

(22) Filed: Mar. 3, 2014

(65) Prior Publication Data

US 2015/0059134 A1 Mar. 5, 2015

(30) Foreign Application Priority Data

Sep. 2, 2013 (CN) ..... 2013 1 0403087
Sep. 2, 2013 (CN) ..... 2013 2 0555606 U

(51) Int. Cl.

| | |
|---|---|
| ***B42F 1/00*** | (2006.01) |
| ***B42F 3/04*** | (2006.01) |
| *B42F 13/06* | (2006.01) |
| *B42F 13/08* | (2006.01) |

(52) U.S. Cl.

CPC . *B42F 3/04* (2013.01); *B42F 13/06* (2013.01); *B42F 13/08* (2013.01); *Y10T 24/20* (2015.01)

(58) Field of Classification Search

CPC ..... B42F 3/04; B42F 13/02; B42F 3/00; B42F 13/06; B42F 13/08; B42F 13/10; Y10T 24/20

See application file for complete search history.

(56) References Cited

U.S. PATENT DOCUMENTS 1,936,144 A * 11/1933 Wagner ..... B42F 13/08 402/17
1,997,635 A * 4/1935 Forth ..... B42F 13/08 402/17
2,136,021 A * 11/1938 Roscoe ..... B42F 13/08 402/15
2,148,255 A * 2/1939 Brennan ..... B42F 13/08 402/15
2,329,869 A * 9/1943 Zwickel ..... B42F 13/08 402/17
2,434,083 A * 1/1948 Snyder ..... B42F 13/08 402/16
2,477,417 A * 7/1949 Pitt ..... B42F 13/08 402/15
2,498,901 A * 2/1950 Segal ..... B42F 13/02 402/17
2,507,912 A * 5/1950 Kern ..... B42F 13/08 402/15
2,767,452 A * 10/1956 Lombardi, Jr. ..... B42F 3/00 281/44

FOREIGN PATENT DOCUMENTS

| | | | |
|---|---|---|---|
| CN | 2474327 | Y | 1/2002 |
| CN | 102285276 | A | 12/2011 |
| JP | S50-027920 | U | 3/1975 |

* cited by examiner

*Primary Examiner* — Robert J Sandy
*Assistant Examiner* — Michael Lee
(74) *Attorney, Agent, or Firm* — Mei & Mark LLP

(57) ABSTRACT

The present disclosure provides a simpler paper fastener, comprising: an upper binding piece in shape of a long strip, binding strips, a lower binding piece in shape of a long strip, wherein there are two binding strips, which are respectively connected to the two ends of the upper binding piece, the two ends of the lower binding piece each have a binding hole. Most importantly, the distance between the middle parts of the two ends of the lower binding piece is equal to or less than the length of the upper binding piece. In the present disclosure, by modifying the length of the lower binding piece without mounting two sliding pieces thereon, an embodiment of the present invention reduces manufacturing processes of a traditional paper fastener and improves the fixing effect of binding.

7 Claims, 4 Drawing Sheets

SIMPLE PAPER FASTENER

PRIORITY

This application claims the priority of Chinese Patent Application 201310403087.2 filed on Sep. 2, 2013 and the Chinese Patent Application 201320555606.2 filed on Sep. 2, 2013, the content of which is incorporated herein by reference.

TECHNICAL FIELD

The present disclosure relates to the field of document binding, in particular to a paper fastener.

BACKGROUND

An existing simple paper fastener is generally made of ferrous metals, comprising an upper binding piece in shape of a long strip, binding strips, and a lower binding piece in shape of a long strip. Two binding strips are connected to the two ends of the upper binding piece. Two sliding pieces are disposed on the lower binding piece, and the lower binding piece is longer than the upper binding piece. The two ends of the lower binding piece each have a binding hole; the distance between the centers of the two binding holes is usually the length of the upper binding piece.

During binding of documents, two holes are made on the documents, with the distance of the centers of the holes equal to the length of the upper binding piece, the two binding strips are passed through the holes in the documents and then through the two binding holes of the lower binding piece, and are bent onto the lower binding piece, and then the two sliding pieces of the lower binding piece are moved to fix the binding strips.

The disadvantage, however, is that the binding strips are not well fixed by the sliding pieces, and the sliding pieces can be easily shifted, which disturbs the documents, and the ends of the metal binding strips often scratch people. Accordingly, people tend to use this kind of paper fastener less and less, and choose more complex binding equipment.

SUMMARY

In view of the above problems of the prior art, the present disclosure provides a simpler paper fastener. It does not need the two sliding pieces on the upper and lower binding pieces and the length of the lower binding pieces is reduced, which saves some material and makes the binding strips fixed more stably. With such a fastener, one does not need to worry that the ends of the binding strips might scratch people. Specifically, the simple paper fastener according to an embodiment of the present invention comprises: an upper binding piece in shape of a long strip, binding strips, a lower binding piece in shape of a long strip, wherein there are two binding strips, which are respectively connected to the two ends of the upper binding piece, the two ends of the lower binding piece each have a binding hole. Most importantly, the distance between the middle parts of the two ends of the lower binding piece is equal to or less than the length of the upper binding piece.

In the present disclosure, by modifying the length of the lower binding piece without mounting two sliding pieces thereon (in a traditional simple paper fastener, the two sliding pieces are required, otherwise binding is impossible), an embodiment of the present invention reduces manufacturing processes of a traditional paper fastener, hides the binding strips after binding, and makes it almost impossible to scratch people. Therefore, the present invention discloses paper fasteners that are safer and improve the fixing effect of binding.

BRIEF DESCRIPTION OF THE DRAWINGS

The accompanying drawings, which are incorporated in and constitute a part of this specification, illustrate several embodiments of the disclosure and together with the description, serve to explain the principles of the disclosure.

In which: 1, upper binding piece; 2, binding strip; 3, lower binding piece; 4, binding hole; 5, connecting shaft; 6, positioning protrusion; 7, positioning recess.

DETAILED DESCRIPTION

The technical solution of the embodiments of the present disclosure will be expressly described with references to the drawings for the embodiments. Based on the embodiments of the present disclosure, all other embodiments made by those skilled in the art without creative labor fall into the scope of the present disclosure.

Embodiments of the present disclosure are primarily improvement on the lower binding piece of the existing simple paper fastener. The length of the lower binding piece is made equal to or less than the length of the upper binding piece. And the binding strip is entered into the binding hole in a mounting direction different from the conventional one.

Figure 1:
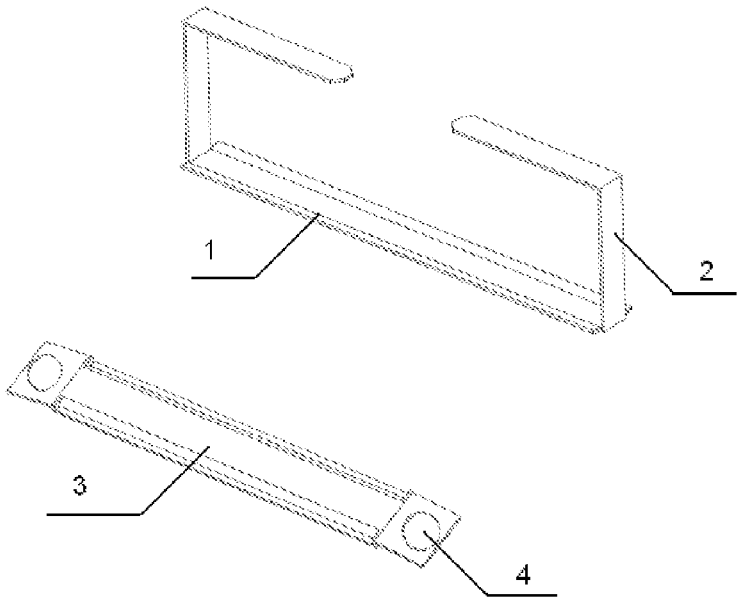
FIG. 1 is a schematic view of a structure according to the present disclosure.

Specifically, FIG. 1 is a schematic view of a structure of the present disclosure. The simple paper fastener shown in the figure comprises an upper binding piece 1 in shape of a long strip, binding strips 2, a lower binding piece 3 in shape of a long strip, wherein there are two binding strips 2, which are respectively connected to the two ends of the upper binding piece, the two ends of the lower binding piece each have a binding hole 4, the distance between the middle parts of the two ends of the lower binding piece 3 is substantially equal to the length of the upper binding piece 2. In the FIG. 2, the middle part of the binding strip 2 is folded into a right angle, which illustrates the binding strip in a binding state; the binding strip 2 is usually a straight strip when it is not actually in a binding state.

Figure 2:
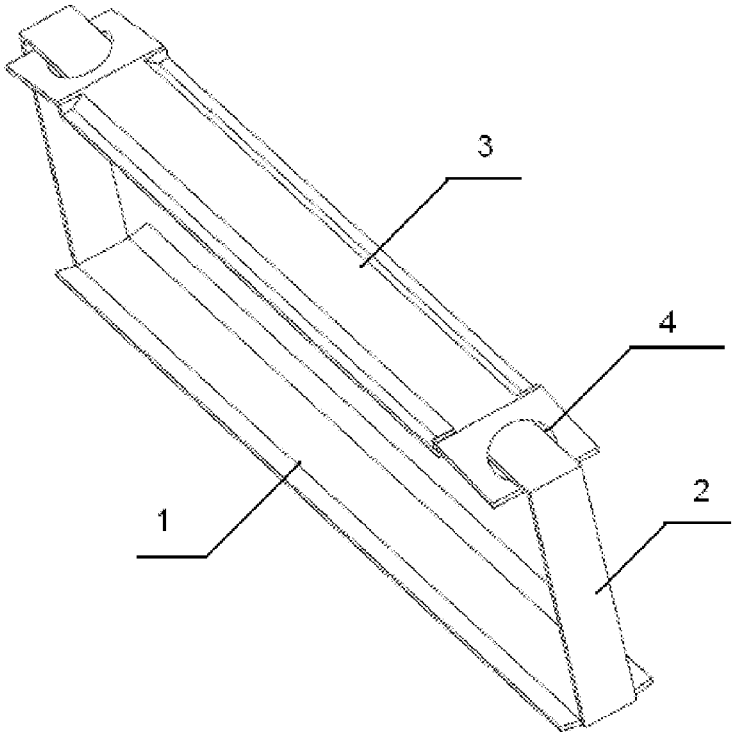
FIG. 2 is a schematic view of a binding structure according to the present disclosure.

FIG. 2 is a schematic view of a binding structure of the present disclosure. The figure shows: during binding, the binding strips 2 pass through the binding holes 4 of the lower paper fastener 3, and the respective ends of the binding strips 2 are positioned between the upper binding piece 1 and the lower binding piece 3. In the figure, the ends of the binding strips 2 are hidden, and they are invisible when normally bound and used. A groove is disposed on the lower binding piece 3, the groove is concaved away from the upper binding piece 1. The groove is used to accommodate the ends of the binding strip for better binding effect.

Figure 5:
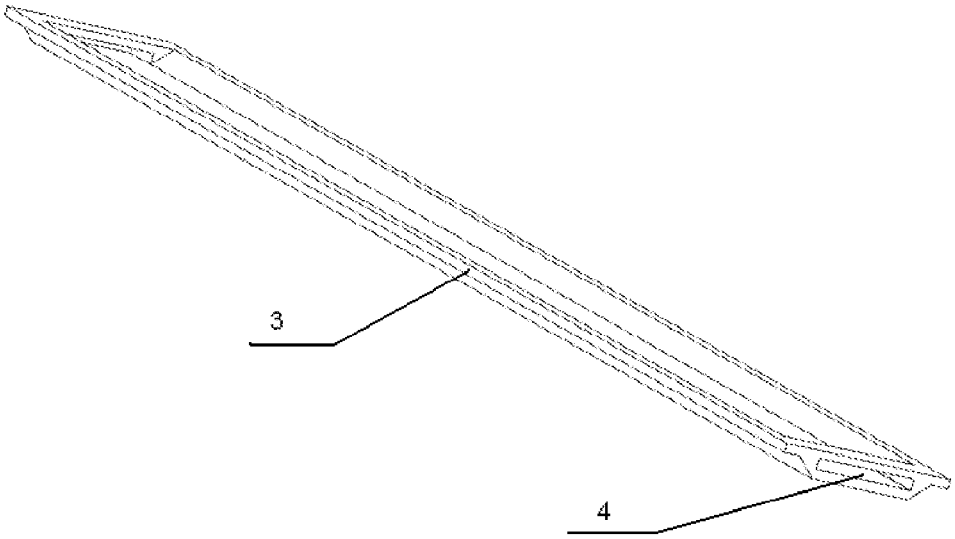
FIG. 5 is a schematic view of the structure of a lower binding piece according to the present disclosure.
Figure 6:
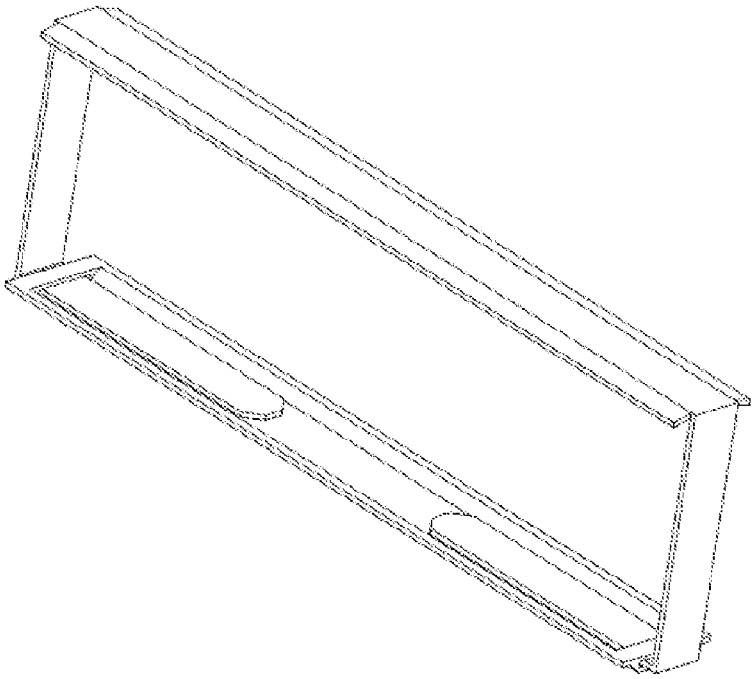
FIG. 6 is a schematic view of the binding structure of the lower binding piece of FIG. 5.

The binding holes 4 may have the conventional form shown as in FIG. 1. The two ends of the lower binding piece 3 in the conventional form can be bent inwardly at the middle of the binding holes, so that the binding holes become flat crescent-shaped gaps. The binding holes can also be the flat rectangular shape at the ends of the lower binding piece 3 as shown in FIG. 5. FIG. 6 shows the binding state of the simple paper fastener with the binding holes of the shape shown in FIG. 5.

A conventional simple paper fastener is usually 80 mm long, and the distance between the centers of the binding holes of the corresponding lower binding piece is 80 mm. The preferred length of the lower binding piece is 80 mm, and the distance between the centers of the two binding holes of the lower binding piece with the traditional form must be shorter than 80 mm.

Figure 7:
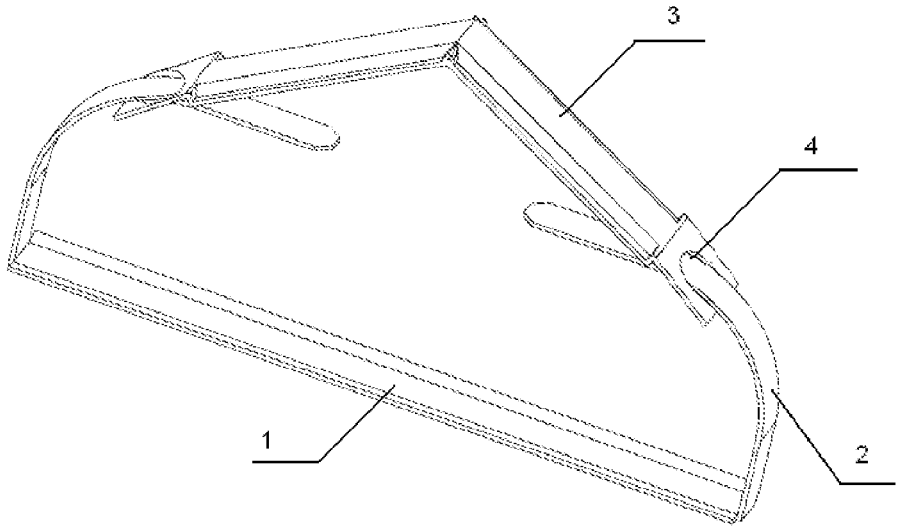
FIG. 7 shows the state of binding when the lower binding piece is mounted.

When made of one whole part, the lower binding piece can be made of iron material. During binding, the lower binding piece need to be bent inwardly in the middle, and then bounce back to a straight strip after the binding strips are entered into the binding holes from the outside, which finishes the binding process. If the binding need to be dismounted and re-done for many times, repetitive bendings have adverse effect on the binding. The lower binding piece may be made of elastic material, such as elastic plastics or steel. The lower binding piece made of elastic material can be dismounted and mounted for many times, and the mounting can be conveniently done by bending it into a certain arc, as shown in FIG. 7.

The lower binding piece of the present disclosure can be composed of one part or two parts. If the lower binding piece is made by connecting two parts, the two parts are connected through a connecting shaft. A positioning recess is disposed on one part, and a positioning protrusion is disposed on the other part. When the two parts are positioned at an angle of 180 degrees, the positioning protrusion fits into the positioning recess.

Figure 3:
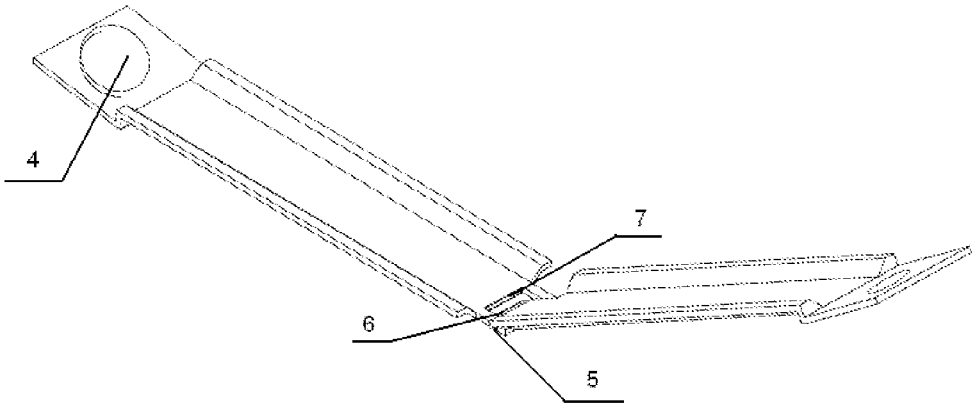
FIG. 3 is a schematic view of the structure of a lower binding piece according to the present disclosure.
Figure 4:
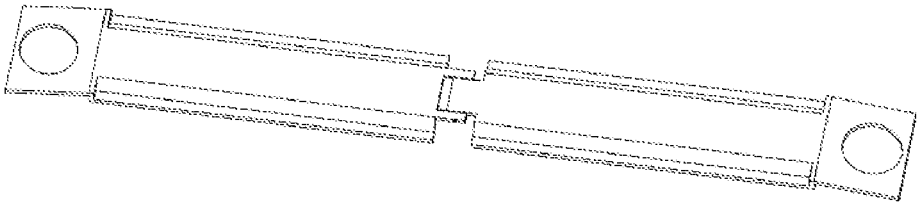
FIG. 4 shows the snap-fit state of the structure of FIG. 3.

Such an arrangement can have many forms, among which one is shown in FIGS. 3 and 4. The connecting shaft 5 is equally distanced to the two ends of the lower binding shaft, the positioning recess 7 is concaved in a direction parallel to the part of the lower binding piece where the recess is located, the positioning protrusion 6 protrudes in a direction parallel to the part of the binding piece where the protrusion is located. The positioning recess 7 and the positioning protrusion 6 snap-fit with each other at the proximity of the connecting shaft 5.

Figure 8:
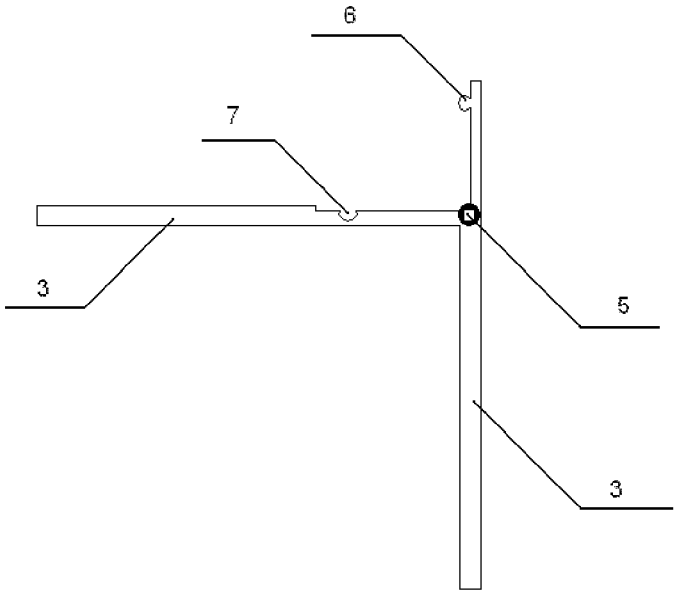
FIG. 8 is a schematic sectional view of the lower binding piece according to the present disclosure.

The lower binding piece composed of two parts can be of another form, whose sectional structural view is shown in FIG. 8. As shown in FIG. 8, the connecting shaft 5 is equally distanced to the two ends of the binding piece, the positioning recess 7 is concaved in a direction perpendicular to the part of the lower binding piece where the recess is located, the positioning protrusion 6 protrudes in a direction perpendicular to the part of the binding piece where the protrusion is located. The two parts of the lower binding piece 3 can form a maximum angle of 180 degrees. When the two parts form an angle of 180 degrees, the part of the binding piece where the positioning protrusion 6 is located partially covers the other part where the positioning recess 7 is located, and the two parts snap-fit with each other.

FIG. 7 shows how the binding is carried out when the lower binding piece 3 of the simple paper fastener is composed of two parts. From FIG. 7, one can also contemplate the lower binding piece need to be bent to a certain degree if it is composed of one part. In such a case, if the lower binding piece is made of iron with no elasticity, the binding state will be similar to that shown in FIG. 7. If the lower binding piece is made of elastic material, the binding state is still similar to that shown in FIG. 7, but the arc will be smooth during bending.

In the preceding specification, various preferred embodiments have been described with reference to the accompanying drawings. It will, however, be evident that various other modifications and changes may be made thereto, and additional embodiments may also be implemented, without departing from the broader scope of the invention as set forth in the claims that follow.

Obviously, one skilled in the art can make various modifications and variations of the disclosure without departing from the spirit and scope of the disclosure. Accordingly, the modifications and variations of the present disclosure fall into the scope of the claims and technical equivalent, and the present disclosure is intended to include these modifications and variations.

I claim:

1. A simple paper fastener, comprising:

an upper binding piece in shape of a long strip, binding strips, and a lower binding piece in shape of a long strip, wherein at least two binding strips are respectively connected to the two ends of the upper binding piece, wherein each of the two ends of the lower binding piece has a binding hole and the distance between the middle parts of the two ends of the lower binding piece is equal to or less than the length of the upper binding piece, wherein the lower binding piece is made by connecting two parts, the two parts being connected through a connecting shaft, a positioning recess is disposed on one part, and a positioning protrusion is disposed on the other part, and wherein when the two parts are positioned at an angle of 180 degrees, the positioning protrusion fits into the positioning recess.

2. The simple paper fastener according to claim 1, wherein the connecting shaft is equally distanced to the two ends of the lower binding shaft, the positioning recess is concaved in a direction parallel to the part of the lower binding piece where the recess is located, the positioning protrusion protrudes in a direction parallel to the part of the binding piece where the protrusion is located, and the positioning recess and the positioning protrusion snap-fit with each other at the proximity of the connecting shaft.

3. The simple paper fastener according to claim 1, wherein during normal binding, the binding strips are passed through the binding holes of the lower paper fastener, and the respective ends of the binding strips are positioned between the upper binding piece and the lower binding piece.

4. The simple paper fastener according to claim 1, wherein the binding holes are notches at the parts of the two ends of the lower binding piece bending inwardly, the bending part being positioned between the upper binding piece and the lower binding piece in a binding state.

5. The simple paper fastener according to claim 1, wherein the binding holes have a flat rectangular shape.

6. The simple paper fastener according to claim 1, wherein the lower binding piece is made of elastic material.

7. The simple paper fastener according to claim 1, wherein the connecting shaft is equally distanced to the two ends of the binding piece and the positioning recess is concaved in a direction perpendicular to the part of the lower binding piece where the recess is located, the positioning protrusion protrudes in a direction perpendicular to the part of the binding piece where the protrusion is located, and wherein the two parts of the lower binding piece can form a maximum angle of 180 degrees, and when the two parts form an angle of 180 degrees, the part of the binding piece where the positioning protrusion is located has an extended portion covering the other part and the positioning recess or positioning protrusion on the extended part snap-fits with the positioning protrusion or positioning recess on the other part.

* * * * *